United States Patent [19]

Farris et al.

[11] 4,166,481

[45] Sep. 4, 1979

[54] CLOSED LIQUID TRANSFER SYSTEM

[76] Inventors: Darrel D. Farris, 4766 Pixie Ave., Lakewood, Calif. 90712; Dan Riggi, P.O. Box 997, Blythe, Calif. 92225

[21] Appl. No.: 910,485

[22] Filed: May 30, 1978

[51] Int. Cl.[2] ..... B65B 3/04

[52] U.S. Cl. ..... 141/1; 141/19; 141/91; 220/314; 222/87

[58] Field of Search ..... 222/87; 220/314; 141/19, 330, 329, 1–12, 85–93

[56] References Cited

U.S. PATENT DOCUMENTS

| | | | |
|---|---|---|---|
| 1,371,103 | 3/1921 | Lucas | 220/314 |
| 2,051,981 | 8/1936 | Bowman | 141/19 |
| 3,993,221 | 11/1976 | Boynton | 222/87 |

*Primary Examiner*—Houston S. Bell

*Attorney, Agent, or Firm*—Gausewitz, Carr & Rothenberg

[57] ABSTRACT

A toxic liquid is transferred from a closed shipping container to a dispensing tank without contamination of the operator or the ambient environment by placing the container in a sealed chamber and forcing a container puncturing probe through the interior of the chamber and entirely through the closed container. The probe extends in a slidable and sealed relation through a lid of the sealed housing and is driven through the container by a lever. Both liquid flow and air relief conduits connect the chamber to the dispensing tank to permit gravity or powered flow of the toxic liquid from the sealed chamber. The probe is hollow and is employed to spray a rinsing liquid into both the container and the chamber after they have been emptied of the toxic liquid.

12 Claims, 6 Drawing Figures

FIG. 2.
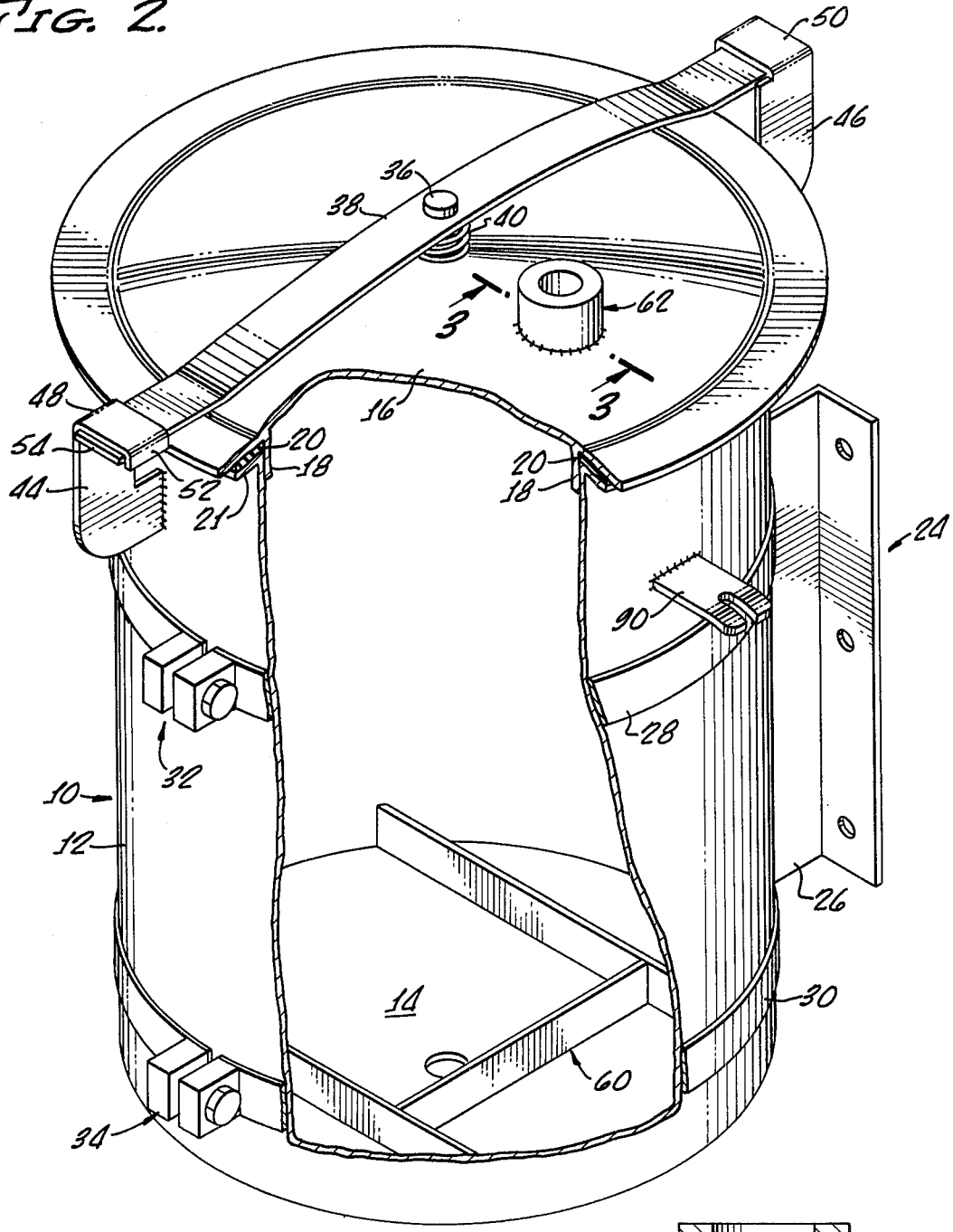
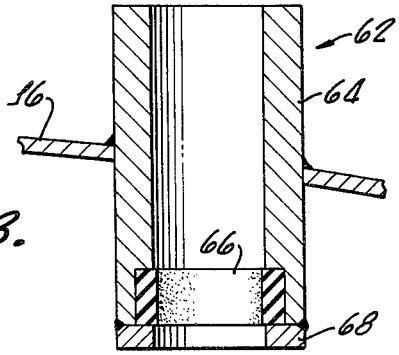
FIG. 3.

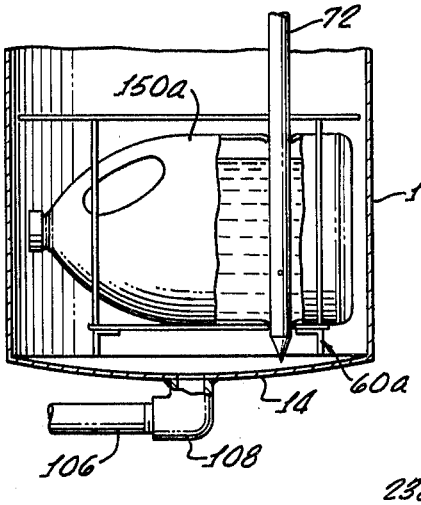
FIG. 4.
FIG. 5.
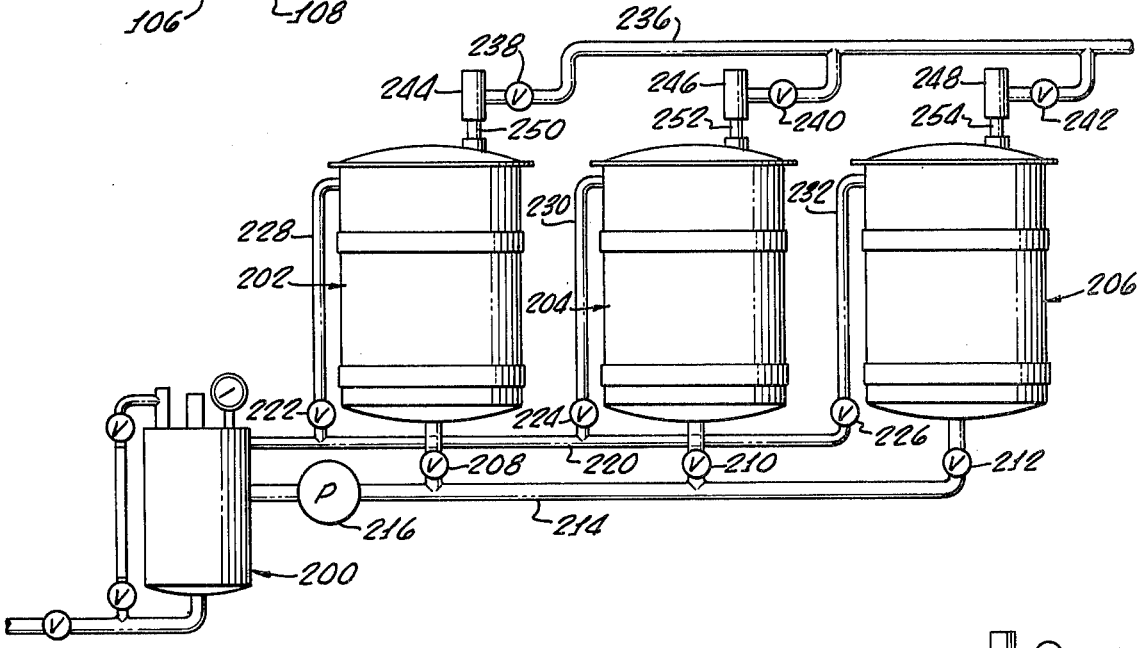
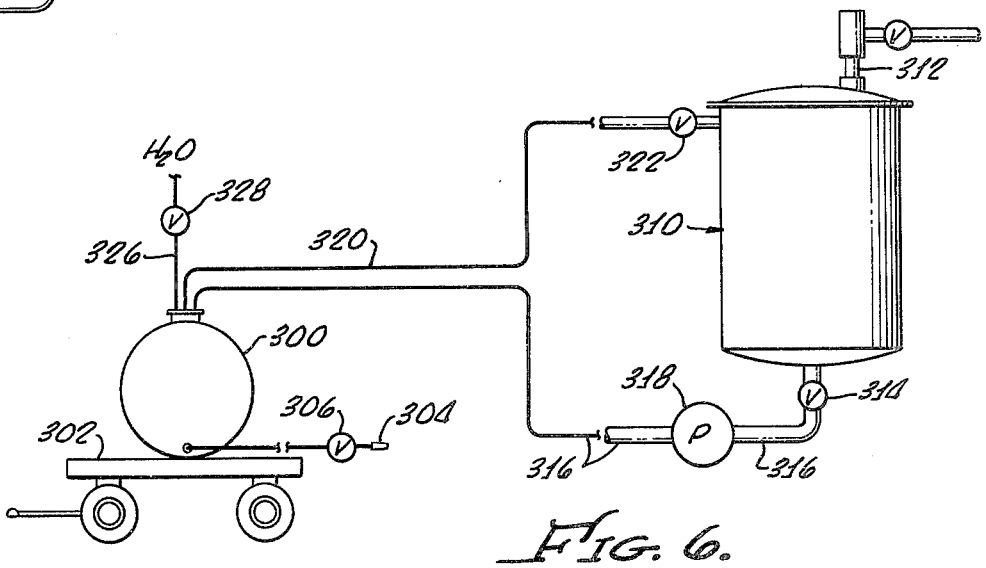
FIG. 6.

CLOSED LIQUID TRANSFER SYSTEM

BACKGROUND OF THE INVENTION

Many types of agriculture employ pesticides and herbicides in large quantities. These toxic liquids are generally packaged and shipped in highly concentrated solutions in closed containers of one, two, five or more gallon capacity. In the field a measured amount of the toxic liquid is transferred from the shipping container to a dispensing tank, from which the concentrated liquid is supplied to a sprayer or other applicator, in which the concentrated liquid is mixed with a diluting fluid such as water before spraying. The diluted spray, of course, is considerably less dangerous to people and other animals than is the concentrated liquid.

Great care must be taken in the handling of the concentrated liquid before its dilution. Possible contamination of people in the vicinity of the toxic concentrate, whether by contact with the liquid or its vapors, must be minimized. In common field practice, the shipping container is provided with a removable top or some other type of detachable closure. After this has been removed by hand, the container is tilted to pour its contents into the tank. The highly toxic nature of the materials being handled requires that the people performing this operation have some skill and training and a strong respect for the dangers involved. Yet the very nature of the agricultural operation in which these types of chemicals are quite frequently used indicates a strong probability that the people handling the chemical may have little skill or experience and may fail to take proper precautions.

Health laws of many localities require that a container that has held toxic chemicals be rendered unfit for reuse before it is disposed of in a common dump. Alternatively, special precautionary procedures must be followed in disposal of the container. Thus it is desirable to destroy the container before disposal.

Accordingly, it is an object of the present invention to provide an apparatus and method for transfer of toxic liquids which avoid or minimize above-mentioned problems.

SUMMARY OF THE INVENTION

In carrying out principles of the present invention in accordance with a preferred embodiment thereof, a closed toxicant filled container is placed in a sealed chamber wherein it is punctured by a device contained within the chamber but operable from outside of the chamber. In a particular mechanization, an elongated probe is slidably mounted in and sealed to a probe guide that is fixed to the chamber housing and a forcing means is provided to drive the probe through the container within the chamber. Both liquid flow and air relief conduits interconnect the interior of the sealed chamber with the interior of a tank to which the toxic liquid is to be transferred, thus maintaining a closed transfer system wherein the toxic liquid cannot come into contact with anything external to the system until it has been diluted for spraying. According to a feature of the invention, the probe is hollow and arranged to flow a cleansing liquid into the emptied container and into the interior of the chamber after the contents of the container have flowed to the transfer tank.

BRIEF DESCRIPTION OF THE DRAWINGS

FIG. 2 is an enlarged pictorial view, with parts broken away, showing details of the housing construction;

FIG. 3 is a section taken on lines 3—3 of FIG. 2;

FIG. 4 is a view similar to FIG. 1, showing the probe extending through a punctured container of a different type;

FIG. 5 shows an arrangement of plural sealed housings connected to a single transfer tank; and FIG. 6 illustrates a sealed container puncturing housing connected directly to a spray tank.

DETAILED DESCRIPTION

Figure 1:
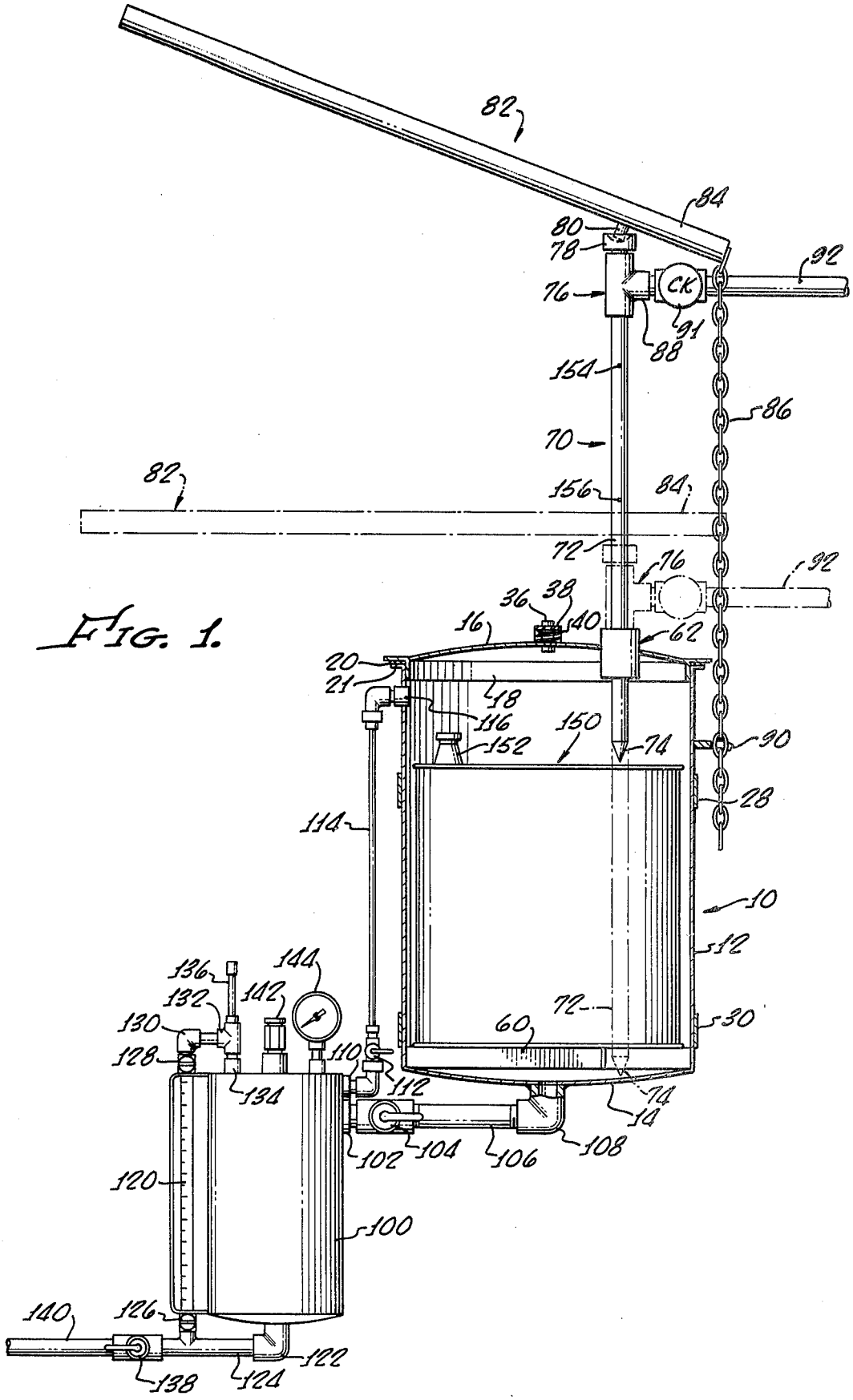
FIG. 1 is a side elevational view of apparatus embodying principles of the present invention showing the probe in position to puncture a container.

As shown in FIG. 1, a sealed housing shell comprises a cylindrical housing or tank 10 of stainless steel or other suitable noncorrosive or corrosion resistant material. The tank is illustrated as having a substantially right circular cylindrical configuration with upstanding side walls 12, an integral bottom wall 14, and a detachable domed top wall or lid 16. The lid is formed with a fixed depending peripheral splash ring 18 circumscribed by a flat annular washer or gasket 20 which bears upon the upper surface of an outwardly extending circumferential flange 21 fixed to the top edge of the side walls 12 to seal the lid to the body of the housing. The splash ring is a close fit against the interior surface of the side walls to further protect the sealed joint against the direct application of rinsing liquid as will be more particularly described below.

A mounting bracket 24 comprises a pair of standoff plates of which only that designated at 26 is shown. The plates are fixed to the housing wall 12 by being welded or otherwise fixed to a pair of flexible steel straps 28, 30 that tightly circumscribe the housing. The straps are secured by bolt and nut clamps 32, 34. The bracket 24 is formed with a number of apertures by means of which the tank or housing 10 may be bolted to a suitable support carried on the side or the back of a farm vehicle or the like.

Fixed to a central portion of lid 16 and extending upwardly therefrom and sealed thereto is a headed bolt or stud 36 upon which is pivotally mounted a latch bar 38 that extends diametrally across the lid and projects for a short distance beyond the lid on each side of the housing. A compression spring 40 circumscribes the bolt 36 between the lid 16 and the latch bar to press the latch bar upwardly and, concomitantly, to press the lid downwardly relative to the latch bar. A pair of diametrally opposed latch brackets 44, 46 are fixed to upper portions of the wall 12 of the housing and include horizontally projecting arms 48, 50 having shallow downwardly projecting lips 52 configured and arranged to capture the outward ends 54 of the latch bar when the latter is depressed against the action of the spring and pivoted to engage the latch bracket. With this arrangement, the lid is readily removed simply by depressing the latch bar and pivoting it slightly about the axis of bolt 36, whereby the lid may be readily lifted from the housing. Thus a closed toxicant filled container may be readily placed into or removed from the interior of the housing 10 with the lid removed. The lid may be simply and easily replaced, being locked and sealed to the housing body to seal the chamber interior. A suitable support, preferably in the form of a skeletal framework 60, is connected to or placed in the housing at the bottom thereof to firmly support the toxicant bearing container above the bottom of the housing.

A probe guide 62 extends through an aperture formed through the housing lid and is fixed to the lid as by welding or the like (FIG. 3), having a portion extending into the chamber within the housing and a portion extending externally of the chamber. Guide 62 comprises a tubular sleeve 64 having the interior of one end rebated or recessed to mount a resilient corrosion-resistant seal 66 which is held in place against longitudinal motion relative to the tube by means of a washer 68 that is fixed as by welding to the inner end of the sleeve 64.

A probe 70 in the form of an elongated hollow member or tube 72 is provided at one end with a solid point 74 and at the other end with a fitting 76 which is preferably a conventional T-fitting. One vertical leg of the T-fitting is threaded down upon and sealed to the upper end of the tube 72 and the other vertical leg of the T receives a threaded sealing plug 78. Plug 78 provides on its upper surface a fulcrum on which bears a short lug 80 that is fixed to and projects downwardly from an intermediate point of a lever 82. The end of a relatively short arm 84 of lever 82 is connected to one end of a tension chain 86 that has the other arm adjustably and detachably connected to a chain holding bracket 90 fixed to and projecting outwardly from the side wall 12 of the housing so as to provide a readily adjustable length to the tension chain 86.

T-fitting 76 has a horizontal leg 88 to which is connected a check valve 91 that is detachably connected to a hose 92 for flowing water or other cleansing fluid from the hose through the check valve and into and through the interior of the tube 72.

Probe tube 72 is a snug sliding fit within the bore of the guide 62 and is sealed thereto by means of the contact of seal 66 with the exterior of the probe, whereby, when the probe is inserted into and through the guide, the housing chamber is sealed.

A closed transfer or dispensing tank 100 has a liquid input fitting 102 connected to a manually controlled valve 104 which in turn connects by means of a conduit 106 and a fitting 108 to an aperture formed in the bottom wall 14 of housing 10. A vent fitting 110 extends from an upper portion of the transfer tank and is connected by means of a valve 112 and conduit 114 to a fitting 116 that extends through an upper portion of the wall 12 of the housing. Thus with valves 104 and 112 both open, liquid can flow from the bottom of the housing chamber into the transfer tank and air can flow from the transfer tank into the housing chamber as the liquid flows therefrom. The transfer tank may be provided with a bracket (not shown) by which it can be mounted adjacent, but below, the housing 10 to enable gravity induced flow from the housing chamber to the transfer tank.

A transparent tubular gage 120 is connected to the bottom of the transfer tank by means of an output fitting 122, a conduit 124 and a valve 126 at one end of the gage and connected at the upper end of the gage to the upper end of the tank by means of a valve 128, an elbow fitting 130, a T-fitting 132 and an input fitting 134. The upper end of T-fitting 132 is connected to a self-closing air input fitting 136 which allows for the admission of pressurized air to the interior of the tank to assist in the discharge of the contents thereof when deemed necessary or desirable. Output conduit 124 of the transfer tank is connected by means of a valve 138 to an output conduit 140 which conveys the contents of the transfer tank to a sprayer or other material dispenser.

An air relief valve 142 and a pressure gage 144 are provided on the transfer tank as additional safety features.

In operation of the described transfer system, the housing lid 16 is removed, valves 112 and 104 are closed, and a closed container 150 is placed into the housing chamber mounted on the skeletal support 60 adjacent to but spaced from the bottom wall 14. The container is provided with a conventional closure 152 which is not opened and need not be opened at any time. Container 150 may carry concentrated herbicide, insecticide or other liquid that is hazardous to handle.

The housing lid is replaced and locked in sealed relation to the housing body. Probe 70 is inserted into the probe guide until its point rests on a top wall of container 150. Lever 82 is placed with its leg 80 bearing upon the fulcrum surface of plug 78 with the short leg 84 of the lever in a relatively lower position, as shown in FIG. 1. With the lever in this position, a link of the chain 86 is engaged with the chain holding bracket 90 so as to take the slack out of the chain. The free end of the lever is pivoted downwardly about its fulcrum (counterclockwise as viewed in FIG. 1), tensioning the chain. This drives the fulcrum vertically downwardly with the entire probe moving downwardly under the driving force of the lever. At the end of the lever stroke, the probe has penetrated at least the top wall of the container but may not yet have penetrated the bottom wall. In this case the lever is repositioned with the chain 86 shortened and re-attached to the holding bracket 90, whereby a second stroke of the lever causes still further penetration of the probe into the chamber. Two or three lever strokes are sufficient to drive the probe point through the bottom of container 150 until the probe point is positioned at or nearly at the bottom wall 14 of the housing as illustrated in dotted lines in FIG. 1. Motion of the probe beyond this limiting position is prevented by abutment of T-fitting 76 with the top of guide 62.

The probe is illustrated in FIG. 4 in its lowermost position, having completely penetrated upper and lower walls of a container. FIG. 4 illustrates a modified form of container 150*a* and a modified form of container support 60*a*. It will be readily appreciated that the supports and containers illustrated are merely exemplary of many different types of container supports and container configurations that may be employed in the methods and apparatus described herein.

The probe point 74 is preferably fluted or otherwise configured so that the hole in the container that is formed by the puncturing point of the probe will be slightly larger, or of a somewhat different configuration, at least in portions thereof, than the periphery of the probe immediately above the point. Thus the hole formed by the puncturing point of the probe allows liquid to escape (or air to enter) through the hole even though the probe body is still within the puncture. Various types of probe point configurations may be employed, including the described fluted point, an enlarged head, or a tetrahedral or other configuration that will form a puncture hole through which the liquid (or air) can flow while the probe extends through the hole. Obviously the probe may be raised to increase the rate of flow from the container, but it is preferred to avoid withdrawal of the probe until the interior of the container and housing have been rinsed, as will be described below.

When the probe has punctured the top and bottom walls of the container liquid flows into the housing chamber from the hole in the bottom of the punctured container as air flows in through the hole in the top. Valves 104 and 112 are opened, valve 138 of the transfer tank is closed, and gage valves 126, 128 are opened. Liquid then flows through the conduit 106 into the transfer tank and air displaced from the transfer tank flows through the conduit 114 into the upper end of the housing chamber to maintain an equalized pressure within the chamber, thus allowing the toxic liquid to freely flow under the force of gravity from the housing chamber into the transfer tank. When a predetermined amount of liquid has been transferred to the tank 100, as may be determined from viewing the gage 120, valves 104 and 112 are closed and valve 138 may be opened to flow the liquid to the dispensing apparatus as necessary or desirable. If needed to enhance the rate of flow of liquid from the transfer tank, air under pressure is supplied via fittings 136 and 132 and 134, with valves 126 and 128 closed. Similarly, a pump (not shown in FIG. 1) may be connected in conduit 106 to speed flow from housing 10.

After use of the liquid in transfer tank 100, additional liquid may be transferred from the housing to the transfer tank. When all of the liquid has been transferred from the container and chamber to the transfer tank and when all of the liquid from the latter has been used, the apparatus may be internally flushed. All of the apparatus has remained sealed until it has been completely emptied and, preferably, probe 72 has remained in place to complete the sealing. When the housing and tank are empty, the valve 138 is closed, and valves 104 and 112 are open. A suitable cleansing liquid such as water under pressure is connected to hose 92 to flow through the check valve 91 through the interior of the hollow tube 72 and thence outwardly through a number of apertures, such as those indicated at 154 and 156, that are formed in and circumferentially spaced about the body of the probe. Upper apertures 154 are positioned within the probe at a point above the upper wall of the container and below the housing lid when the probe is in lowermost position, whereas apertures 156 are positioned to be below the upper wall of the container (with the probe in the lowermost position). Thus the pressurized flushing liquid from the probe is sprayed substantially radially from the probe by means of the plurality of apertures 154 and the plurality of circumferentially spaced apertures 156 to impinge upon the interior of the housing and upon the interior of the container and to rinse these of contaminating liquid. The splash ring helps to protect the sealing during the rinse. The rinse liquid flows through the conduit 106 into the transfer tank which is thereby also rinsed. The rinse contents of the transfer tank may thereafter be discharged by applying air pressure to the fitting 136 and opening outlet valve 138.

The housing may have many other configurations and many other arrangements of a sealing closure or lid may be employed to permit transfer of a closed liquid container into and out of the chamber.

Other arrangements may be made to drive the probe through the container but the described arrangement wherein the probe is moved vertically down through both top and bottom walls of the container is preferred since the container will empty more readily under gravity with two holes.

Illustrated in FIG. 5 is an arrangement wherein a single closed transfer or dispensing tank 200 is connected to three sealed housings 202, 204 and 206. Transfer tank 200 may be identical to transfer tank 100 of FIG. 1 and each of the sealed housings 202, 204 and 206 may be identical to the housing 10 shown in FIG. 1. The probe operating levers and their chains have been omitted from the illustration of FIG. 5. Each of the housings 202, 204 and 206 has the interior thereof connected by respective independently operable and manually controlled valves 208, 210 and 212 to a common output conduit 214 which is connected to the input of a pump 216 that forces fluid to the input of transfer tank 200. Similarly a common vent conduit 220 is connected to an upper portion of transfer tank 200 and, by means of independently operable and manually controlled valves 222, 224 and 226 and conduits 228, 230 and 232, respectively, is separately connected to the several housings at upper portions thereof. A common flushing liquid conduit 236 is connected via independently operable and manually controlled valves 238, 240, 242 to the respective housing T-fittings 244, 246 and 248, which are secured to the top of the container puncturing probes 250, 252 and 254, respectively.

The arrangement of FIG. 5 may be employed to transfer different herbicides or insecticides to the transfer tank. Thus a container of one type of herbicide may be placed in housing 202. It may then be opened as previously described and a selected amount of this material transferred to tank 200, leaving the remaining herbicide within the chamber of housing 202. After the material in transfer tank 200 has been used, a different material from a container in housing 204 or 206, for example, may then be selectively transferred to the transfer tank 200 and dispensed as necessary. Thus, with the system of FIG. 5, portions of the contents of containers in each of the three housings may be transferred to the transfer tank for use one at a time while other portions of the same toxicants remain as yet unused within the respective housing chambers. Further, the arrangement of FIG. 5 enables mixing of several liquids by transferring predetermined amounts of each of two or more liquids into the transfer tank 200.

The arrangements of FIGS. 1–5 utilize a transfer tank with a volume gage (gage 120 of FIG. 1) to enable use of measured amounts of the toxic liquid that is to be dispensed. However, in many cases the entire contents of a container of toxicant liquid are to be used so that no measurement of a portion of the contents of such container need be made. For example, as illustrated in FIG. 6, a spray tank 300 is carried on a vehicle 302 for dispensing a suitably diluted insecticide or herbicide through a nozzle 304 under control of a valve 306. The spray tank has a known capacity, such as 500 gallons for example. In such a case it is only necessary to fill the spray tank with water and then add five gallons of the toxicant to obtain a diluted mixture of one to one hundred. Accordingly the entire contents of a five gallon toxicant container may be transferred to the spray tank 300. For this type of application, there is provided a sealed housing 310 having a container puncturing probe 312 and a probe operating lever and chain (not shown), all of which may be identical to the corresponding housing, probe, lever and chain previously described. After puncturing the toxicant container as described above, the contents of the sealed housing chamber 310 are fed through a valve 314, a conduit 316, and, via a pump 318, are forced to the spray tank 300. Air from spray tank 300 flows through a conduit 320 and a valve 322 into the upper portion of the housing chamber 310. The interior of spray tank 300 is sealed, the conduits 316, 320 and a water input conduit 326 being fed into the tank through sealed fittings. Thus the entire dispensing system is sealed and undiluted toxicant cannot contact anything external to the transfer system.

With the arrangement of FIG. 6, the toxicant container is placed in the housing 310, the housing is sealed and the container punctured as previously described in connection with the embodiment of FIGS. 1–3. Valves 314 and 322 are then opened and pump 318 is operated to transfer the entire contents of the punctured container to the spray tank 300. The latter is filled with an appropriate quantity of water via water input line 326 and a control valve 328 and the properly diluted toxicant is now ready for dispensing. After the toxicant is dispensed, the interior of the toxicant container and of the housing chamber are rinsed as previously described and then the housing may be opened and the container removed and discarded.

If deemed necessary or desirable, the arrangement of FIG. 6 may employ a plurality of housings, each identical to housing 310 and all connected in parallel (by both liquid and air conduits analogous to conduits 316, 320) directly (via a pump) to the spray or dispenser tank 300 in the manner illustrated in FIG. 5.

A significant function of transfer tank 100 (FIG. 1) is to facilitate measurement of different amounts of toxicant. Such measurement can be accomplished alternatively by placing a suitable gage on the sealed housing 10 or by employing a flow measuring meter in the housing output line 106. In such arrangements the transfer tank may be eliminated and measured quantities of concentrated toxicant may be fed directly to a dispensing tank as in the arrangement of FIG. 6.

It will be observed that the entire transfer takes place with the toxic liquid confined in a sealed chamber and in the closed, sealed transfer tank, that none of the toxicant liquid is exposed to any of the ambient environment until it leaves the dispensing apparatus, that an open contaminated or toxicant liquid filled container need not be handled and that the container is destroyed by the puncturing probe and rinsed so that it may be safely discarded. The apparatus is simple to manufacture and simple to operate, requiring little skill or experience and yet the operators are protected at all times from contamination by the toxic liquid.

The foregoing detailed description is to be clearly understood as given by way of illustration and example only, the spirit and scope of this invention being limited solely by the appended claims.

What is claimed is:

1. A closed system for transfer of liquids without exposure to ambient environment comprising a housing shell defining a sealed chamber having an access opening, closure means for sealing said opening and adapted to permit transfer of a closed liquid container into and out of said chamber, a probe guide fixed to and extending through said shell, said guide having a bore extending therethrough, an elongated probe adapted to be inserted into said chamber through said probe guide bore in slidable and sealing relation to said bore, means for driving said probe within said chamber to puncture a closed container positioned within said chamber, a tank, conduit means for flowing liquid from said chamber to said tank, said conduit means including a first conduit connected between said chamber and said tank, and a relief conduit connected between said chamber and said tank for flowing gas from said tank to said chamber, whereby said chamber and tank may remain in vapor tight and liquid tight sealed relation to ambient environment during transfer of liquid therefrom to said tank.

2. The system of claim 1 wherein said probe comprises an elongated hollow member closed at one end thereof, and means for flowing a cleansing liquid into a first portion of said member, said probe having apertures therein positioned both above and below the upper wall of a container within said chamber when said probe has been driven to puncture said container whereby cleansing liquid may be projected into said chamber and into said container without moving said probe.

3. The system of claim 1 including a support mounted within said chamber for supporting a closed container above the lowermost portion of said housing, whereby said probe may be driven through upper and lower walls of said container and the contents of said container will flow to the bottom of said chamber.

4. The system of claim 1 wherein said housing comprises a shell having side walls, a bottom and an open top, and wherein said closure means comprises a lid detachably connected to and sealed upon said shell side walls to seal the open top thereof, said probe guide being fixed to and extending through said lid.

5. A system for transferring toxic liquids from a closed container to a dispensing tank without exposing the liquid or its vapors to ambient environment, said system comprising a housing shell having side walls, a bottom wall and an open top, a housing lid detachably secured to said housing shell across the open top thereof to seal the interior of said shell, a probe guide fixed to and extending through said lid into the interior of said shell, said guide having a bore extending therethrough, an elongated probe removably extending through said bore, said bore having a container puncturing end, means for sealing said bore to said probe, driving means for forcing said probe through said bore into the interior of said shell toward the bottom of said shell, a dispensing tank for receiving contents of a container positioned in said shell, a first conduit connecting a lower portion of the interior of said shell with the interior of said tank, and a second conduit connecting an upper portion of the interior of said shell with said tank, whereby as contents of a container within said shell flow to said tank from the interior of said housing, fluid will flow from said tank to an upper portion of said shell housing, and the contents of the container and vapors thereof are confined in a closed system.

6. The system of claim 5 including a plurality of sealed housings, each having a probe guide, and a probe extending through and sealed to the guide, and driving means for forcing the probe through the interior of the housing, independent conduit means for flowing liquid to said tank from any selected one of said housings, and independent vent conduit means for flowing gas from said tank to any selected one of said housings, 7. The system of claim 5 wherein said probe is a hollow member having a fitting for receiving a flushing liquid and having flushing apertures positioned at points above and below the upper portion of a container positioned within said shell whereby both the interior of said container and the interior of said shell may be flushed with a flushing liquid projected from said probe without moving said probe.

8. The system of claim 5 including a pair of oppositely disposed hook members fixed to opposite sides of said shell, a latch bar pivoted to said lid and extending across said lid for engagement with said hook members, and a compression spring interposed between said lid and said latch bar.

9. A method of transferring toxic liquid without exposure to ambient environment comprising the steps of placing a closing container of toxic liquid within a sealed chamber, puncturing at least a lower portion of the closed container while it is within said chamber and while said chamber is sealed, whereby toxic liquid from said container will flow into said chamber, flowing liquid from said chamber to a closed tank while said chamber is sealed, and flowing fluid from said tank to said chamber as liquid flows from said chamber to said tank.

10. The method of claim 9 wherein said step of puncturing said container comprises inserting a container puncturing probe into said chamber in slidable sealed relation thereto, and forcing said probe into said container.

11. A closed system for transfer of liquids without exposure to ambient environment comprising a housing shell defining a chamber having an access opening, a closure means for sealing said opening and adapted to permit transfer of a closed liquid container into and out of said chamber, a probe guide fixed to and extending through said shell, said guide having a bore extending therethrough, an elongated probe adapted to be inserted into said chamber through said probe guide bore in slidable and sealing relation to said bore, and means for driving said probe within said chamber to puncture a closed container positioned within said chamber, said means comprising lever means connected with said housing and adapted to bear upon an upper portion of said probe, said lever means comprising a lever arm fulcrumed upon an upper portion of said probe, and adjustable length tension means connected between said housing and a portion of said lever arm spaced from the fulcrum thereof.

12. A system for transferring toxic liquids from a closed container to a dispensing tank without exposing the liquid or its vapor to ambient environment, said system comprising a housing shell having side walls, a bottom wall and an open top, a housing lid detachably secured to said housing shell across the open top thereof to seal the interior of said shell, a probe guide fixed to and extending through said lid into the interior of said shell, said guide having a bore extending therethrough, an elongated probe extending through said bore, said bore having a container puncturing end, means for sealing said bore to said probe, driving means for forcing said probe through said bore into the interior of said shell toward the bottom of said shell, a dispensing tank for receiving contents of a container positioned in said shell, a first conduit connecting a lower portion of the interior of said shell with the interior of said tank, and a second conduit connecting an upper portion of the interior of said shell with said tank, whereby as contents of a container within said shell flow to said tank from the interior of said housing, fluid will flow from said tank to an upper portion of said shell housing, said driving means comprising a lever fulcrumed upon an upper portion of said probe and an adjustable length tension member connected between said shell and an end of said lever.

* * * * *